US007597562B2

(12) United States Patent
Genesius et al.

(10) Patent No.: US 7,597,562 B2
(45) Date of Patent: Oct. 6, 2009

(54) PLUG-IN CONNECTOR

(75) Inventors: Andreas Genesius, Heilbronn (DE); Matthias Kassner, Heilbronn (DE)

(73) Assignee: Amphenol-Tuchel Electronics GmbH (DE)

( * ) Notice: Subject to any disclaimer, the term of this patent is extended or adjusted under 35 U.S.C. 154(b) by 0 days.

(21) Appl. No.: 11/883,321

(22) PCT Filed: Jan. 30, 2006

(86) PCT No.: PCT/EP2006/000770

§ 371 (c)(1),
(2), (4) Date: Feb. 21, 2008

(87) PCT Pub. No.: WO2006/079555

PCT Pub. Date: Aug. 3, 2006

(65) Prior Publication Data

US 2008/0194150 A1 Aug. 14, 2008

(30) Foreign Application Priority Data

Jan. 28, 2005 (DE) ..... 10 2005 004 103
Jan. 30, 2006 (DE) ..... 10 2006 004 238

(51) Int. Cl.
*H01R 12/00* (2006.01)

(52) U.S. Cl. ..... 439/76.1; 439/372; 439/607.01

(58) Field of Classification Search ..... 439/660, 439/372, 610, 76.1, 607.01
See application file for complete search history.

(56) References Cited

U.S. PATENT DOCUMENTS 4,449,784 A 5/1984 Basov et al.

(Continued)

FOREIGN PATENT DOCUMENTS

| | | |
|---|---|---|
| EP | 0 590 496 | 4/1994 |
| EP | 0 675 570 | 10/1995 |
| WO | WO 97/18603 | 5/1997 |

OTHER PUBLICATIONS

International Search Report, mailed Jun. 1, 2006.

*Primary Examiner*—Javaid Nasri
(74) *Attorney, Agent, or Firm*—Blank Rome LLP

(57) ABSTRACT

A connector has a first male connector and a first female connector. The first male connector includes a male contact support that supports male contact elements, and the first female connector includes a female contact support that supports female contact elements. The first connector has tolerances in the direction of insertion. The first male contact elements of the first male contact support and the first female contact elements of the first female contact support are adapted to come into contact engagement at the time the first male connector and the first female connector are brought into contact engagement. At least one second connector is inserted into or integrated with the first connector, and the second connector includes a second male connector and a second female connector. The second male connector has a second male contact support adapted to support the second male contact elements, and the second female connector has a second female contact support which supports second female contact elements. The second connector has tolerances in the direction of insertion which are smaller than the tolerances of the first connector, and the second male contact support or the second female contact support are moveable in the direction of insertion.

11 Claims, 4 Drawing Sheets

U.S. PATENT DOCUMENTS

| | | | | |
|---|---|---|---|---|
| 5,961,337 | A | 10/1999 | Kordes | |
| 6,641,440 | B1 | 11/2003 | Hyland et al. | |
| 6,746,284 | B1 | 6/2004 | Spink, Jr. | |
| 6,913,487 | B2 * | 7/2005 | Beneke et al. | 439/607.01 |
| 2004/0053534 | A1 | 3/2004 | Beneke et al. | |
| 2004/0077197 | A1 | 4/2004 | Nishide | |

* cited by examiner

PLUG-IN CONNECTOR

CROSS-REFERENCE TO RELATED APPLICATION

This application is a National Phase Application of International Application Number PCT/EP2006/000770, which claims priority to German Patent Application No. 10 2005 004 103.5, filed Jan. 28, 2005, and German Patent Application No. 10 2006 004 238.7, filed Jan. 30, 2006, which are hereby incorporated by reference in their entirety.

BACKGROUND OF THE INVENTION

Field of the Invention

The invention relates to a connector comprising a first male connector and a first female connector. The first male connector is preferably provided with a plug-in support supporting pin or plug-in contacts, while the first female connector comprises in particular a first female contact support supporting female contacts.

SUMMARY OF THE INVENTION

It is an object of the present invention to design a connector of the above-mentioned type such that another connector, in particular a modular connector system, can be integrated.

BRIEF DESCRIPTION OF THE DRAWINGS

Additional advantages, objects and details of the invention will be described below referring to the drawings.

DETAILED DESCRIPTION OF THE INVENTION

Figure 1:
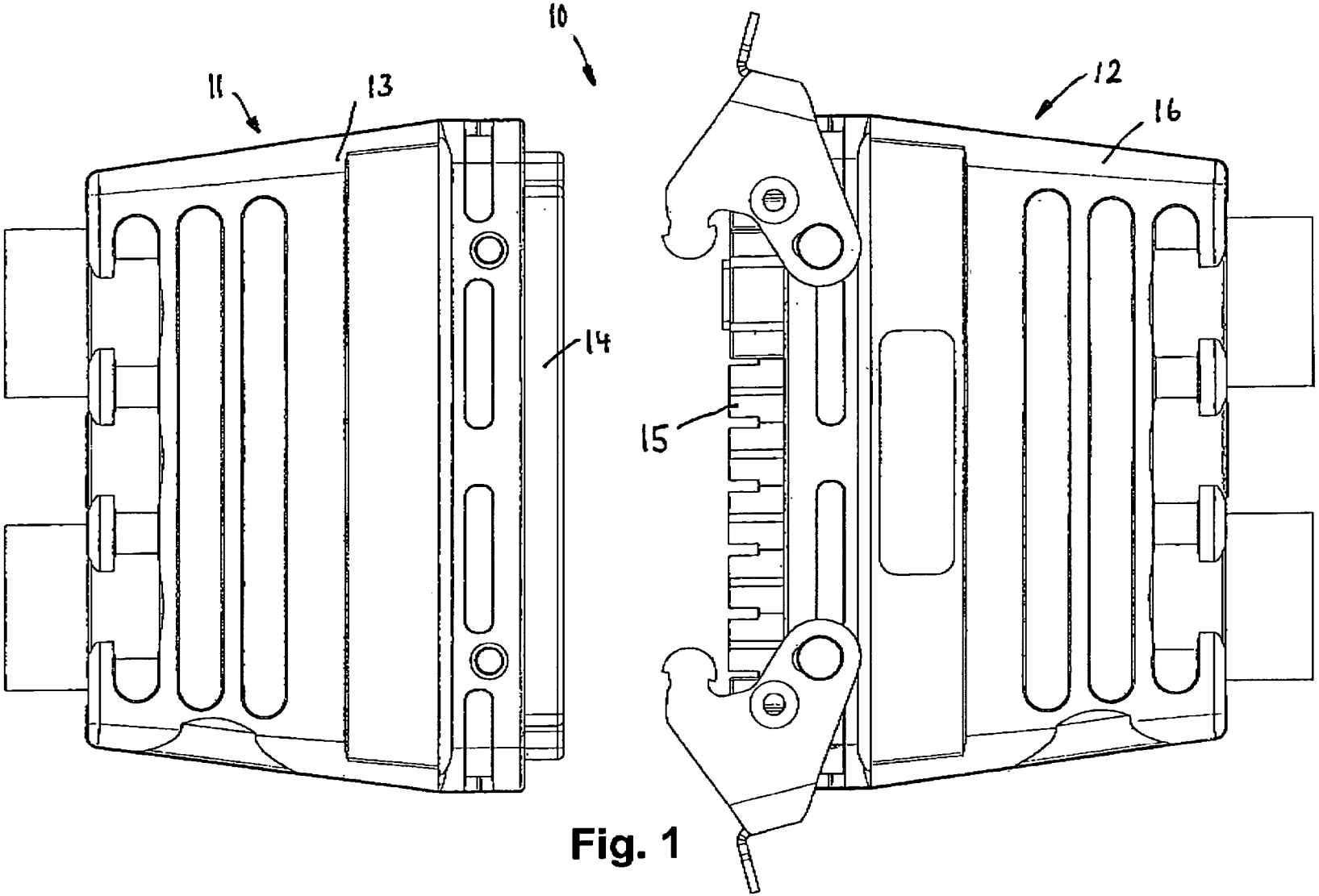
FIG. 1 is a top plan view of a first connector according to the invention comprising a first male connector as well as a first female connector.

In FIG. 1 a first or superior connector (superior connector system) 10 is shown as comprising: a first [pin side] male connector, referred to as first male connector 11, and a first [socket side] connector, referred to in short as first female connector 12. The first male connector 11 comprises a housing 13 as well as a male contact support 14. The female connector 12 comprises a female contact support 15 as well as a housing 16. Both the male contact support 14 as well as the female contact support 15 may have the respective contact elements inserted into the respective contact element supports.

Preferably, the male contact support 14 as well as the female contact support 15 comprise a male connector module frame 23 and a female connector module frame 123, respectively. Preferably, different male connector modules 20, 21 and different female connector modules 30, 31 can be inserted into the respective frames. This is shown for the embodiment disclosed in the drawing and which refers to the integration of the RJ45 connector system into a modular connector system.

Figures 2, 2A, 3, 4:
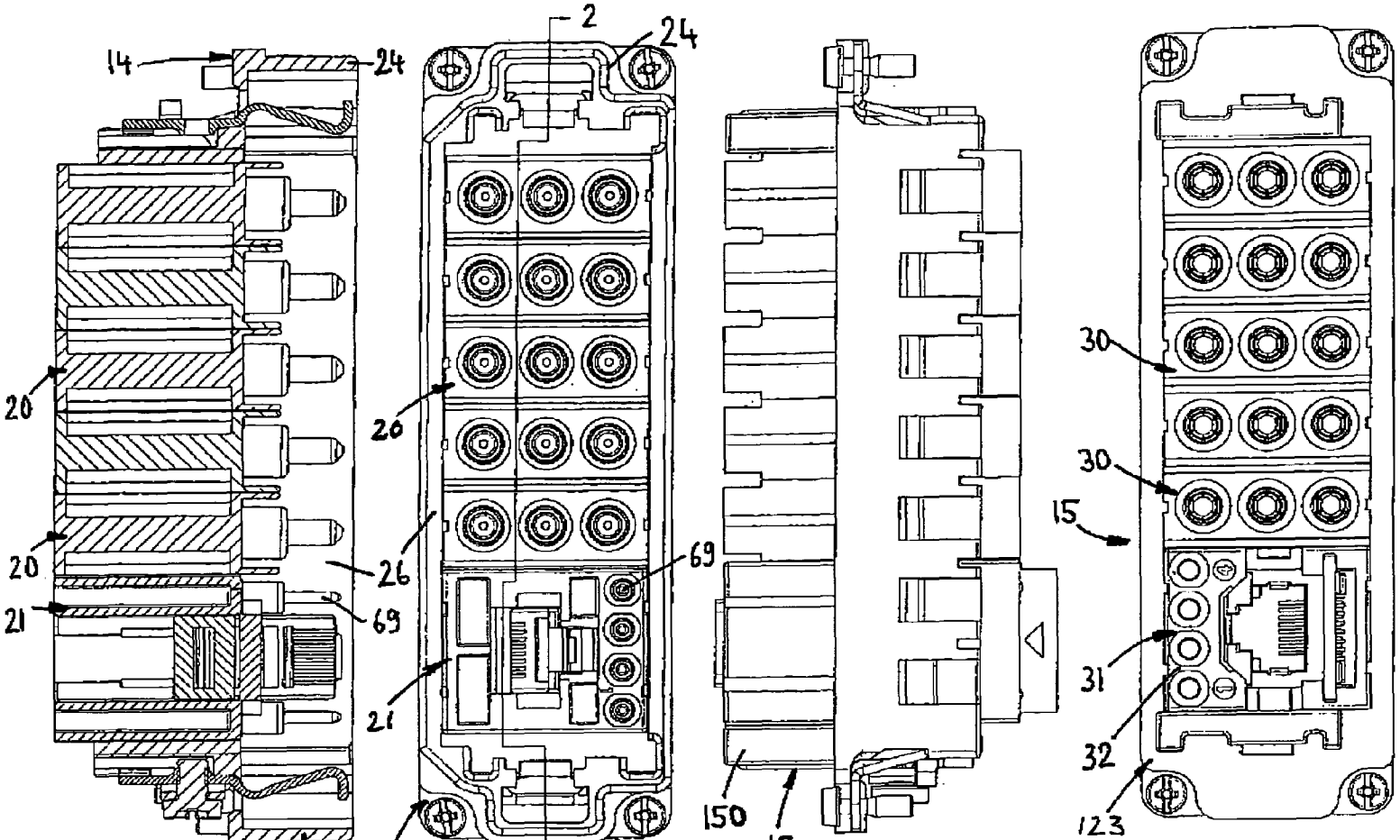
FIG. 2 is schematic sectional view along line 2-2 of FIG. 2A of the first male connector with a housing being deleted and with the first male connector comprising a frame with male connector modules of different design being inserted therein.
FIG. 2A a top plan view onto the connecting side or plug-in side of the first male connector with the housing being deleted.
FIG. 3 a side elevational view of the first female connector with the housing being deleted and with the first female connector comprising a frame, into which female connector modules of different design are inserted.
FIG. 4 a top plan view of the connector side of the first female male connector, said connecting side or receiving side being adapted to cooperate with the connecting side of the first male connector of FIG. 2A, with the housing not being shown.

FIG. 2 is a schematic sectional view of the male contact support 14 together with the male contact support frame 23. The frame 23 comprises (see also FIG. 2A) an upper frame section 24 and a lower frame section 25 as well as a frame side 26. A first male connector module (pin connector module) 21 and a second or a plurality of second connector modules (pin connector module) 20 is/are inserted into said male contact support 14.

FIGS. 3 and 4 disclose that a first female connector module 31 and a plurality of second female connector modules 30 are inserted into the female contact support 15 and the female contact support frame 123, respectively.

The second male connector modules 20, which can be matingly inserted into the second female connector modules 30, form the customary connectors or connections for the power transmission. The first male connector module 21, which can be plugged into the first female connector module 31, preferably serves for the signal transmission and comprises additional contact elements 69.

FIG. 5 through 8 disclose that the first male connector module 21 and the first female connector module 31 form together a connector module 39. The connector module 39 comprises, particularly, a second connector 40 (subordinated connector system 40). The second connector 40, which is also referred to as a signal connector 40, comprises a second male connector 41 (below also called a signal male connector 41) and a second female connector 42 (could also be called a signal female connector 42). The signal male connector 41 is preferably fixedly mounted in the first connector module 21, more specifically in a first male connector module body 22 of the first male connector module 21. The second female connector 42 is located in the first female connector module 31 on a circuit board 51. The circuit board 51 is reciprocally and slidably mounted in the first female connector module 31, i.e. in a first female connector module body 32 of the female connector module 31 in the direction of insertion and in the opposite direction. Preferably, the second connector 40 is a RJ45 connector comprising a RJ45 male connector 41 as well as a RJ45 female connector 42.

Figure 5:
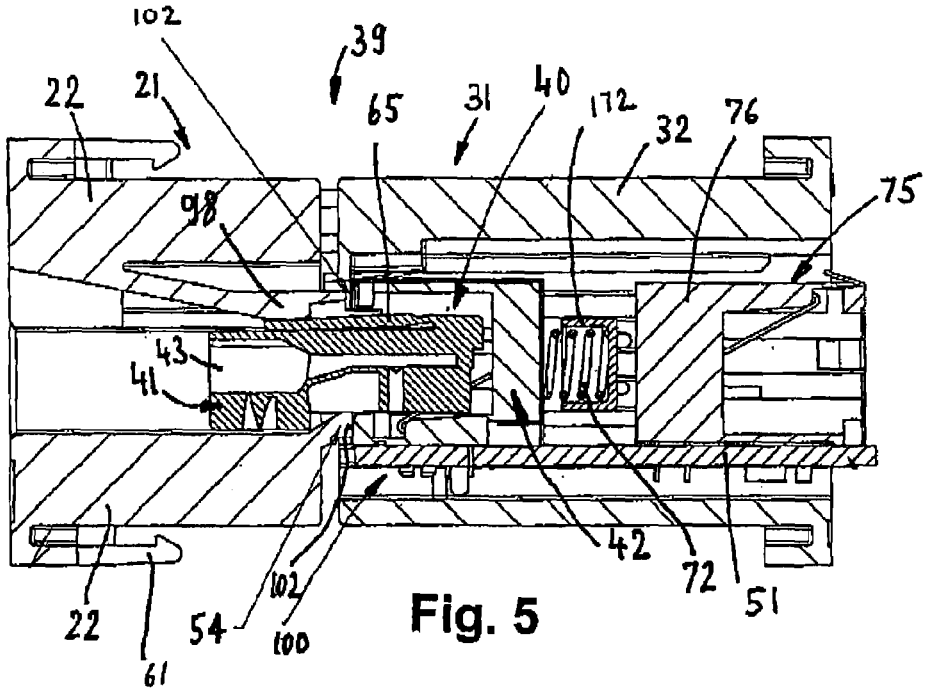
FIG. 5 a sectional view of a second connector comprising a second male connector and a second female connector with the second male connector being part of a first male connector module and with the second female connector being part of a first female connector module, wherein further the second male connector module is shown partially inserted into the second female connector module, not having reached a maximum depth of insertion.

The design of the first or superior connector 10, in particular the design of the (first) male connector support 14 and the (first) female connector support 15, each of which is adapted to receive the male connector modules 20, 21 and the female connector modules 30, 31, respectively, causes, because, all components are subject to certain tolerances of manufacture, a certain tolerance in the direction of insertion ("first insertion depth tolerance") of the first connector 10. This first insertion depth tolerance is larger than the range of the variations of the depth of insertion which is tolerated by the second connector 40, in particular a RJ45 connector. This smaller tolerance in the direction of insertion of the second connector 40 is a characteristic of the second connector 40. This tolerance of the second connector 40 is also called "second insertion depth tolerance". In FIG. 5 the first male connector module 21 and the first female connector module 31 are shown in a first position wherein all tolerances of manufacture of the first connector 10 are assumed to have the smallest value in the direction of insertion. In this situation, the second male connector 41 is already inserted into the second female connector 42 and provides a contact position in accordance with the standard. Thus, the second connector provides contact in accordance with the standard.

Figure 6:
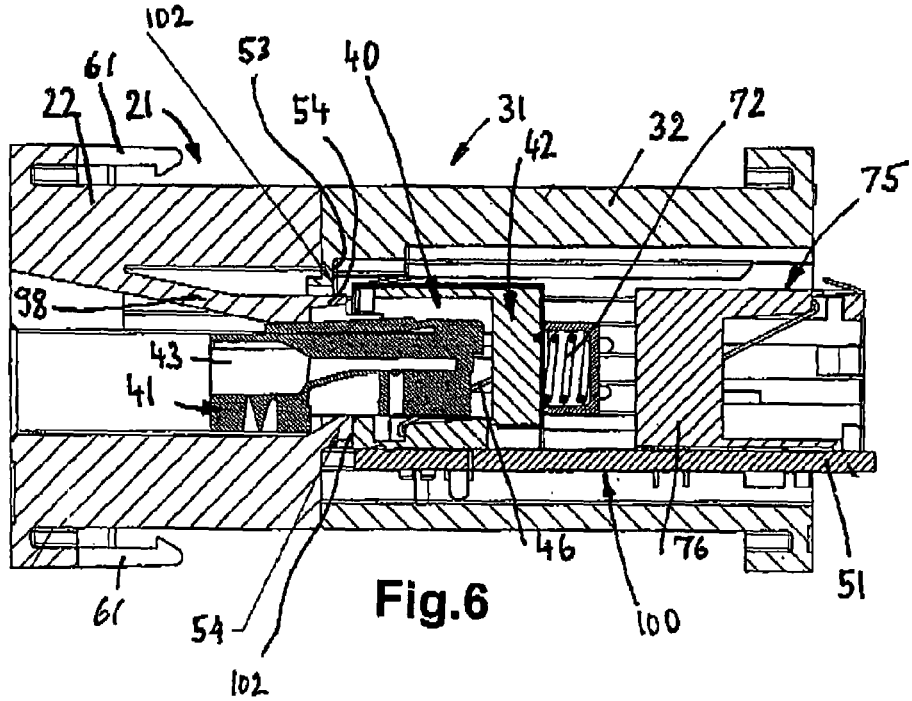
FIG. 6 a representation similar to FIG. 5 showing the first male connector module and the second female connector module being in complete abutment.
Figure 8:
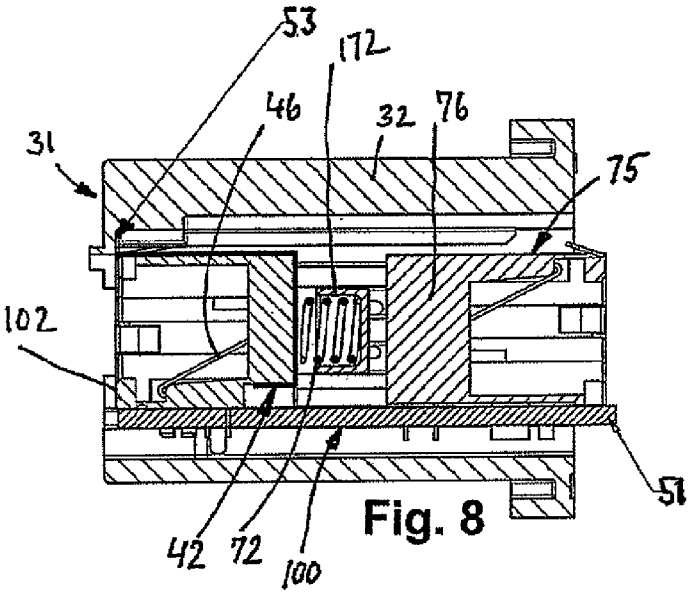
FIGS. 7 and 8 sectional views along lines 7-7 and 8-8 in FIGS. 9 and 10, respectively, of the components shown in FIGS. 5 and 6 in a condition not inserted into each other.

FIG. 6 shows the first male connector module 21 and the first female connector module 31 in a position where all tolerances of manufacture of the connector 10 have been assumed to be maximum (i.e. have the greater value) in the direction of insertion. Here, the first connector module 21 is in complete abutment with the first female module 31. Inasmuch as the second insertion depth tolerance of the second connector 40 cannot compensate the offset—caused by the larger first offset in the direction of insertion due to the insertion depth tolerance—the second or signal female connector 42 is fixedly mounted to the circuit board 51 which is slidably mounted in the first female connector module 31. The circuit board 51 is slidably mounted together with the second female connector 42 of the second connector 40 in the first female connector module 31. The circuit board 51 is subject to a biasing force, preferably the force of a spring. The biasing force is larger than the plug-in force which is required to plug together the second connector 40 contrary to the plug-in direction (direction of insertion) towards a frontal side or front side surface 53 of the first female connector module 31. An abutment surface 102 of the second female connector 42 is in abutment with the inwardly facing frontal side 53. A spring 72, which generates said spring force abuts at a U-shaped support 172 mounted to the first female connector module body 32 and presses against the second female connector 42. The location of the circuit board 51 is selected such that for a maximum plug-in distance (smallest depth of insertion) of the first connector 10, the plug-in connection of the second connector 40 is completely inserted or plugged in, as is shown in FIG. 5. In case that the plug-in distance of the first connector 10 is smaller, (tolerances have the greatest value in the direction of insertion) then the circuit board 51 of second connector 40 is moved against the biasing force in the plug-in direction (direction of insertion) so as to compensate for the tolerance; this occurs when the second connector 40 is completely plugged in as shown in FIG. 6.

To provide for a simple connection, it is possible to locate on the circuit board 51 preferably a second RJ45 female connector 75 (female termination connector). The female termination connector 75 comprises a female termination connector body 76 which supports contact elements 77.

Due to the resilient movement of the circuit board 51 (carrying the second female connector 75), one achieves that the second connector 40 is not damaged and that the first connector system 10 can be completely inserted or plugged in. The arrangement of circuit board 51 and female connector 42 and female connector 75 is also referred to as an intermediate member 100. The intermediate member 100 is reciprocally mounted within the first female connector module body 32 and is biased against the frontal side 53.

For relief of the second male connector 41, in particular for the relief of a detent hook 65 of the RJ45 connector 41, ribs or noses 54 are provided at the first male connector module 21; after completion of the plug-in or insertion operation of the second female connector 40, said ribs 54 abut at the abutment surfaces 102 of the second female connector 42 and, in the case of FIG. 6, the second female connector 42 together with the circuit board 51—i.e. the intermediate member 100—are moved against the bias of the spring 72 in plug-in direction into the first female module 31.

By means of an element 98 mounted in the first male connector module 21, the second male connector 41 is secured against an outward movement contrary to the direction of insertion; in particular for the RJ45 connector 41, the element 98 comes into engagement with the detent hook 65 and presses said detent hook 65 towards the second male connector 41 so as to prevent a detent action or in the inserted condition of the second male connectors 41 in the second female connector 42.

It is also possible to provide a first connector system 10 comprising only one second connector 40, in particular a RJ45 connector 40.

It is also possible to mount the second male connector 41 and/or the second female connector 42 slidably in the direction of insertion.

Moreover, in the first connector further modules, in particular pneumatic modules, can be arranged.

Figure 7:
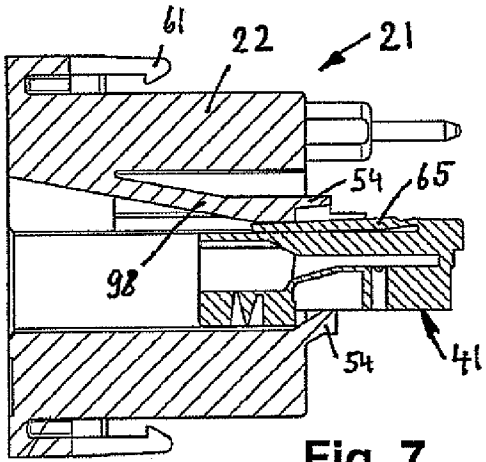
Figure 10:
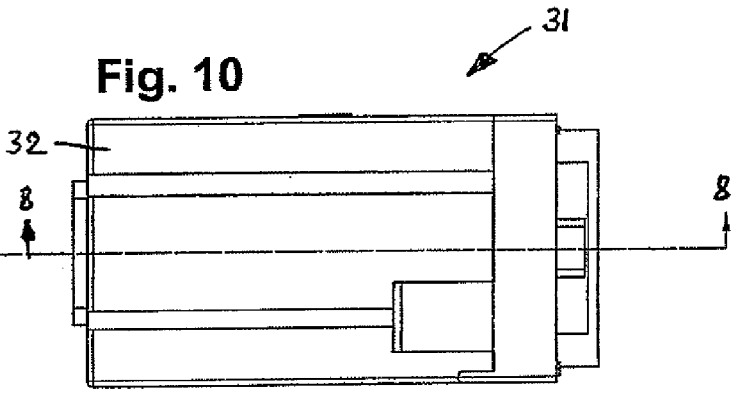
FIGS. 9 and 10 top plan views of the components shown in FIGS. 7 and 8, respectively.
Figure 9:
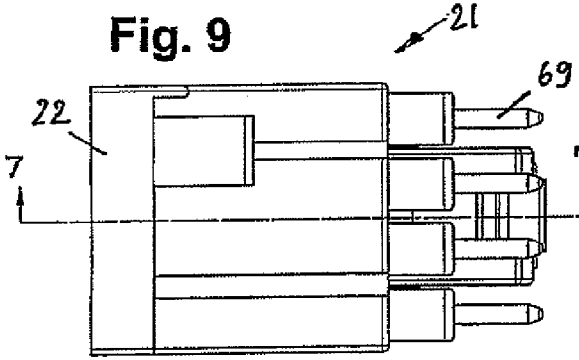

The male and female, respectively connector modules 20, 21, 30 and 31 can be mounted by detent means at the appropriate frame by means of module detent hooks. As an example the module detent hooks 61 are shown in FIGS. 5 to 7.

As is shown, in accordance with the present invention, it is in particular possible to integrate into a modular system C146M (the first or superior connector system 10) a connector (second or subsidiary connector system 40) using an RJ34 connector system. It is possible to readily use standard cables so that a RJ45 connector 41 and a RJ45 female connector 42 are able to mate in the C146 connector. This is made possible by the intermediate member 100 and the two RJ45 female connectors 42, 76.

In a mating C146 system the tolerance of the distances of the frames adapted to receive the RJ45 modules is larger than the admissible plug-in depth tolerance of the RJ45 connector. In accordance with the present invention, the intermediate member 100 is resiliently mounted together with the RJ45 female connectors 42 in the first female connector module body 32, i.e. a frame of the C146 system. As mentioned above, the spring force of the spring 72 is larger than the plug-in force of the RJ45 connector and acts into the direction of insertion. The distance of the RJ45 male connector 41 in the first connector module 21 in the first frame with respect to the RJ45 female connector 32 in the first female connector module body 32 of the second frame 123 of the mating or "plugged-in" C146 system is provided such that also at the largest distance, the frame offers the minimum insertion depth of the RJ45 connector. In case the distance of the frames of the C146 system is too small, then the RJ45 intermediate member 100 with the female connectors 42, 76 resiliently moves such that the RJ45 connector system is not harmed, and at that time the C146 connector system can be completely inserted due to the fact that the nose 54 hits the support surface(s) 102 formed by the frontal surface of the second female connector 42 and moves the female connector body 42 against the spring force of the spring 72 together with the circuit board 51.

The second male connector 41, which is—in the embodiment shown, a RJ45 male connector 41, has to be fixedly held in the connector module body so as to be able to assume or receive the plug-in force.

It is noted that the second male connector 41, which is designed as RJ45 connector 41, is not locked (by detent means) when plugged into the corresponding second female connector 42 which is designed as a RJ45 female connector 42. This is true because of the element 98 which blocks the detent hooks 65. Preferably, element 98 is designed such that the detent hook 65 is, during plug in or insertion, not constantly subject to a load. In accordance with the invention, a sealed housing can be provided for receiving the modules, as shown in FIG. 1. As mentioned, it is also possible that a plurality of modules is arranged adjacent to each other in the housing. The first and second RJ45 female connectors are preferably mounted, as mentioned, on a circuit board.

LIST OF REFERENCE NUMERALS

10 first or superior connector or superior connector system
11 first pin side connector, first male connector
12 first socket side connector, socket side, first female connector
13 housing
14 (first) male contact support
15 (first) female contact support
16 housing
20 second male connector module
21 first male connector module
22 first male connector module body (connector module body)
23 male connector module frame
24 upper frame section
25 lower frame section
26 frame side
30 second female connector module
31 first female connector module
32 first female connector module body (first socket module body)
39 connector module
40 second connector of the RJ45 design (subordinated connector system)
41 second male connector or signal male connector
42 second female connector; signal female connector
43 insulating connector body RJ45
44 insulating socket body RJ45
45 contact elements
46 contact elements
51 circuit board
53 frontal side of the female module body
54 ribs or notes
60 connector module body
61 module detent hooks
65 detent hooks
69 contact elements
72 spring
75 female termination connector
76 female termination connector body
77 contact elements
78 male connector receiving space
98 element
100 intermediate member
102 abutment surfaces of the second female connector 42
123 female connector module frame
140 frame
172 U-shaped spring bearing

The invention claimed is:

1. A first connector having a first male connector and a first female connector, which are adapted to be moved in a direction of insertion, wherein the first male connector comprises a male contact support supporting in particular male contact elements, and wherein the first female connector comprises a female contact support supporting in particular female contact elements, and wherein the first connector comprises tolerances in the direction of insertion, and wherein the first male contact elements of the first male contact support and the first female contact elements of the first female contact support are adapted to come into contact engagement at the time the first male connector and the first female connector are brought into contact engagement, and wherein at least one second connector is inserted into or integrated with the first connector, said second connector being an RJ45 connector comprising a second male connector and a second female connector adapted to be moved in the direction of insertion wherein the second male connector comprises a second male contact support adapted to support second male contact elements, and wherein the second female connector comprises a second female contact support which supports second female contact elements, and wherein the second connector comprises tolerances in the direction of insertion which are smaller than the tolerances of the first connector, and wherein the second male contact support or the second female contact support are movable in the direction of insertion.

2. The connector of claim 1, wherein the second connector is biased against the direction of insertion.

3. The connector of claim 1, wherein in the second female contact support is slidably moveable in the direction of insertion.

4. The connector of claim 1, wherein the second female contact support is biased against the direction of insertion.

5. The connector of claim 1, wherein at least one rib is provided adjacent to the second male connector, said rib being adapted to abut at or adjacent the second female connector at the time the second connector is completely mated, and slidably move the second female connector in case a further sliding movement occurs in the direction of insertion.

6. The connector of claim 1, wherein the male contact elements and the female contact elements as well as the second male connector and the second female connector are respectively arranged in a male connector module and a female connectors module.

7. A superior connector system comprising a first male connector and a first female connector, wherein the first male connector comprises a male contact support, and wherein the first female connector comprises a female contact support, and wherein at least a first male connector module and at least a second male connector module are arranged in the male connector support, and wherein said female contact support, is adapted to receive, forming a secondary connector system belonging to a RJ45 design, a first female connector module and a second female connector module, wherein the first male connector module comprises a first male connector module body with ribs extending therefrom in the direction of insertion, the first female connector module comprising a first female connector module body which comprises abutment surfaces for contacting said ribs, and wherein a circuit board together with a second female connector and a female termination connector forms an intermediate member which is biased against an abutment surface at the first female connector module body.

8. The superior connector system as set forth in claim 7, wherein the first male connector module is arranged in a male connector module frame, and the first female connector module is arranged in a female connector module frame.

9. The superior connector system according to claim 7, wherein the first male connector module comprises a first male connector module body with one or more elements being formed at said first male connector module body, said element or elements being adapted to engage a second male connector and form ribs for cooperation with the abutment surfaces of the second female connector.

10. The superior connector system according to claim 9, wherein the second female connector is mounted on a circuit board arranged in the first female connector module, said circuit board being reciprocally and slidably mounted in the direction of insertion.

11. The superior connector system with said first male connector and said first female connector according to claim 7, wherein the intermediate member is biased contrary to the direction of insertion such that the intermediate member abuts at an abutment surface formed by a front side of the first female connector module body.

* * * * *